United States Patent [19]

Torres et al.

[11] Patent Number: 4,696,656

[45] Date of Patent: Sep. 29, 1987

[54] RECONFIGURABLE TOY

[75] Inventors: Ronald Torres, Pico Rivera; Edward Mayer, Los Angeles; Steve Nelson, Palos Verdes, all of Calif.

[73] Assignee: Mattel, Inc., Hawthorne, Calif.

[21] Appl. No.: 818,839

[22] Filed: Jan. 14, 1986

[51] Int. Cl.[4] ..... A63H 3/46

[52] U.S. Cl. ..... 446/376; 446/384

[58] Field of Search ..... 446/376, 487, 321, 268, 446/381, 383, 384, 385, 380

[56] References Cited

U.S. PATENT DOCUMENTS

| | | | |
|---|---|---|---|
| 152,250 | 6/1874 | Powers | 446/487 X |
| 254,200 | 2/1882 | Crandall | 446/268 X |
| D. 281,087 | 11/1985 | Ohno | D21/128 |
| D. 281,088 | 11/1985 | Murakami | D21/150 |
| 2,118,677 | 5/1938 | Lower | 446/380 |
| 4,411,097 | 10/1983 | Murakami | 446/487 X |
| 4,579,541 | 4/1986 | Kulesza et al. | 446/304 |

FOREIGN PATENT DOCUMENTS

| | | | |
|---|---|---|---|
| 923055 | 2/1955 | Fed. Rep. of Germany | 446/353 |

*Primary Examiner*—Mickey Yu

*Attorney, Agent, or Firm*—Ronald M. Goldman; Melvin A. Klein; Daniel F. Sullivan

[57] ABSTRACT

A reconfigurable toy which may be used to selectively simulate a robotic humanoid figure and a rock configuration. The toy has head, arm and leg members which are rotatably coupled to a torso member. Each member has a surface simulating part of a robotic humanoid figure and a rock simulating surface. The toy may be folded into a compact configuration by rotating the members until they are positioned so that only the rock simulating surfaces of the members are visible and a rock configuration is simulated such as a boulder resting on a supporting surface. The toy may then be unfolded or reconfigured to simulate a robotic humanoid figure supported on two leg members.

3 Claims, 6 Drawing Figures

RECONFIGURABLE TOY

BACKGROUND OF THE INVENTION

The present invention relates generally to reconfigurable toys and, more particularly, to a reconfigurable toy which can be used to selectively simulate a robotic humanoid figure and a rock configuration.

In the past, toys have been used for the purpose of simulating robots, vehicles, airplanes, etc. Typically, these toys may be reconfigured (transformed) from one configuration such as a vehicle to another configuration such as a robot, or vice versa. For example, two patents disclosing reconfigurable toys are U.S. Pat. Nos. Des. 281,087 issued to Ohno on Oct. 22, 1985 and 281,088 issued to Murakami on Oct. 22, 1985. The first patent discloses a toy reconfigurable from a vehicle to a robot and the second patent shows a toy robot which may be reconfigured into an autobike.

None of these toys, however, may be reconfigured from a rock configuration to a robotic humanoid figure, or vice versa. Such a toy would give a child increased enjoyment and play options. For example, the toy in its rock configuration could be used as part of a landscape or a child could pretend to hide the toy in the landscape during play. Also, unfolding the toy from its rock configuration to reveal a robotic humanoid figure results in increased dramatic effect and enjoyment during play. As such, there is need for a reconfigurable toy which may be used to selectively simulate a robotic humanoid figure and a rock configuration.

SUMMARY OF THE INVENTION

It is an object of this invention to provide a reconfigurable toy which may be used to selectively simulate a robotic humanoid figure and a rock configuration.

It is another object of this invention to provide a reconfigurable toy having a plurality of members which may be folded into a compact configuration by rotating the members until they are positioned to simulate a rock configuration resting on a supporting surface.

It is still another object of this invention to provide a reconfigurable toy having a plurality of members which may be unfolded from a simulated rock configuration to simulate a robotic humanoid figure supported by leg members.

These and other objects and advantages are attained by a reconfigurable toy which may be used to selectively simulate a robotic humanoid figure and a rock configuration. The toy has head, arm and leg members which are rotatably coupled to a torso member. The head member is coupled to the torso by a head retainer which is free to rotate inside the torso member. A leg and arm retainer is used to couple the arm and leg members to the torso member. Each member has a surface simulating part of a robotic humanoid figure and a rock simulating surface. The toy may be folded into a compact configuration by rotating the members until they are positioned so that only the rock simulating surfaces of the members are visible and a rock configuration is simulated such as a boulder resting on a supporting surface. The toy may then be unfolded or reconfigured to simulate a robotic humanoid figure supported on two legs.

The various features of the present invention will be best understood, together with further objects and advantages by reference to the following description of the preferred embodiments, taken in connection with the accompanying drawings.

DESCRIPTION OF THE PREFERRED EMBODIMENTS

The following specification taken in conjunction with the drawings sets forth the preferred embodiments of the present invention in such a manner that any person skilled in the toy manufacturing arts can use the invention. The embodiments of the invention disclosed herein are the best modes contemplated by the inventors for carrying out their invention in a commercial environment, although it should be understood that various modifications can be accomplished within the parameters of the present invention.

Figure 1:
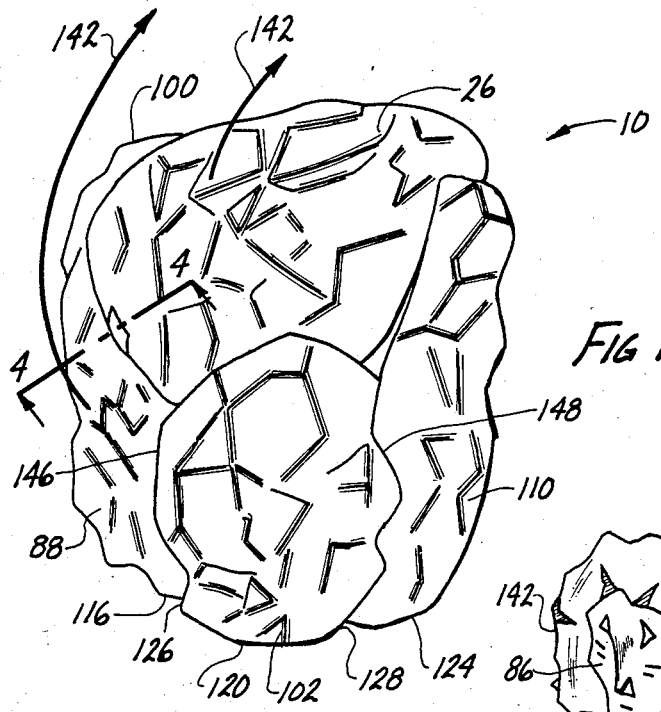
FIG. 1 is a perspective view of a preferred embodiment of the reconfigurable toy of the present invention shown folded into a rock configuration.
Figure 2:
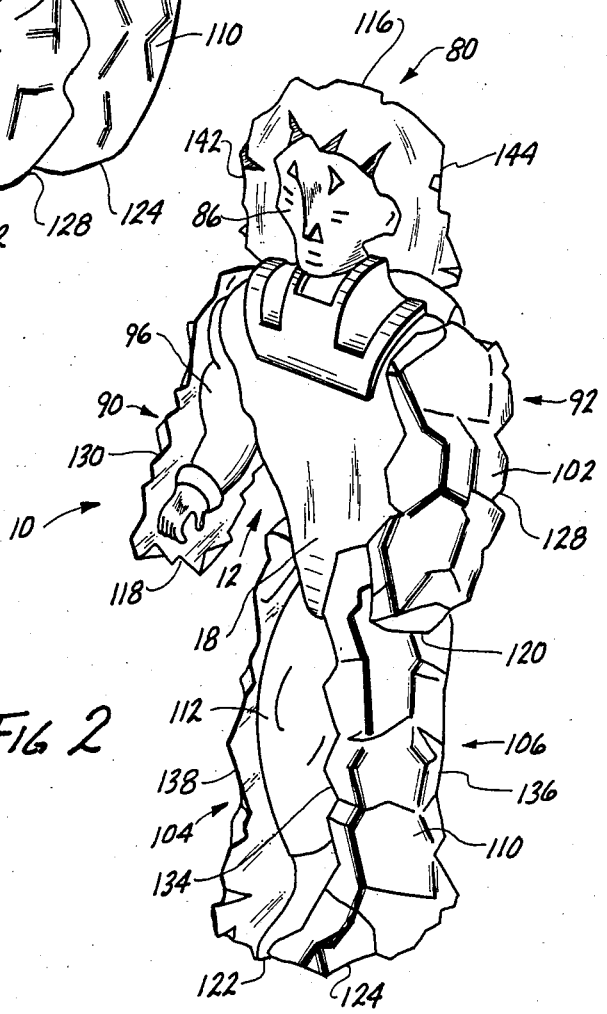
FIG. 2 is a perspective view of the toy of FIG. 1 reconfigured (unfolded) to simulate a robotic humanoid figure supported by leg members.
Figure 3:
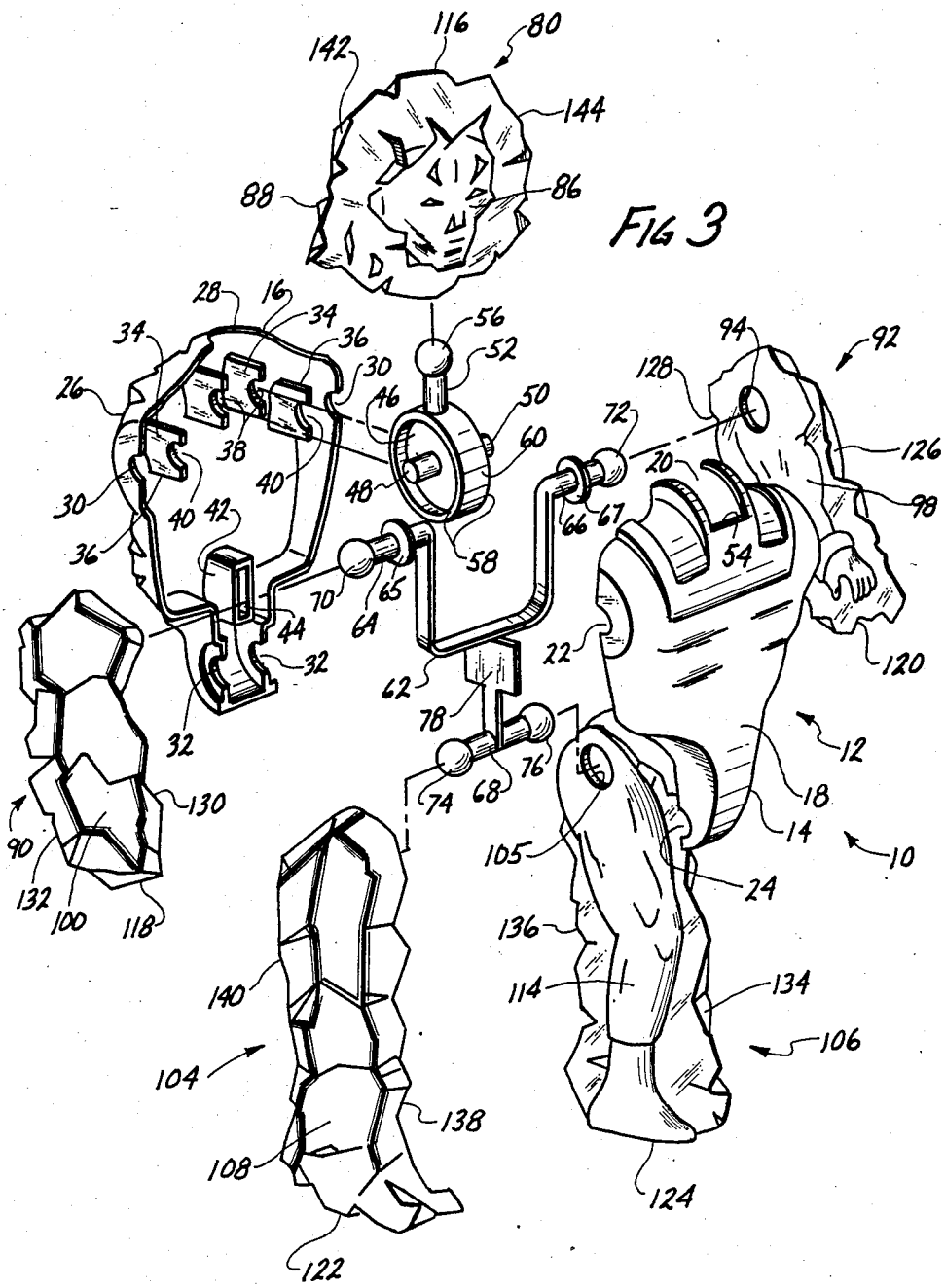
FIG. 3 is an exploded perspective view of the reconfigurable toy showing how head, arm and leg members are rotatably coupled to retainers mounted in a torso member.

Referring now to the drawings and particularly to FIGS. 1 through 3, a preferred embodiment of the reconfigurable toy 10 of the present invention is disclosed. The toy 10 has a hollow torso member 12 having front and rear portions 14 and 16, respectively (see FIG. 3). The portions 14 and 16 may be held together by any conventional means such as pin-and-socket-type connectors (not shown). As best shown in FIGS. 2 and 3, the front portion 14 has an outside surface 18 simulating the torso of a robotic humanoid figure. A slot 20 exists at the top of portion 14. In addition, semicircular apertures 22 and 24 exist at both sides of protion 14. Note that only the apertures 22 and 24 at the left side of portion 14 are shown in FIG. 3, but apertures 22 and 24 also exist at the right side of portion 14.

Rear portion 16 has an outside surface 26 which simulates the surface of a rock (see FIG. 1). A semicircular aperture 28 exists at the top of portion 16 as shown in FIG. 3. Similar to portion 14, semicircular apertures 30 and 32 exist at both sides of portion 16. Webs 34 and 36 are attached to the inside surface of rear portion 16 as shown in FIG. 3. The webs 34 and 36 have semicircular apertures 38 and 40, respectfully. Webs with semicircular apertures (not shown), similar to webs 34 and 36 with semicircular apertures 38 and 40, are attached to the inside surface of the front portion 14. An extension 42 with slot 44 is attached to the inside surface of the rear portion 16. The front portion 14 also has an extension with slot (not shown), similar to extension 42 with slot 44, attached to its inside surface.

Referring to FIG. 3, a head retainer 46 having side pins 48 and 50 and pin 52 attached thereto is mounted inside torso member 12. When portions 14 and 16 are assembled together, side pins 48 and 50 are rotatably mounted in circular apertures formed by the semicircular apertures 38 in webs 34 and similar semicircular apertures in the webs attached to the inside surface of front portion 14. As pins 48 and 50 rotate, pin 52 is free to move forward and backward in slot 20 restricted only by semicircular aperture 28 in portion 16 and edge 54 of slot 20. Note that pin 52 has a ball member 56 attached thereto as shown in FIG. 3. Teeth (not shown) may be molded or fabricated at ends 58 of cylinder 60 to control the rotation of the head retainer 46 if desired. Also, any other type of control means such as a ratchet may be used instead of the teeth.

Referring again to FIG. 3, a Y-shaped leg and arm retainer 62 is also mounted inside torso member 12. The retainer 62 has two top horizontal extensions 64 and 66 and a bottom horizontal member 68. Ball members 70 and 72 are attached to extensions 64 and 66, respectively. Two disk-shaped members 65 and 67 are also attached to extensions 64 and 66. Member 68 has ball members 74 and 76 attached thereto. A plate 78 is formed or molded as part of the leg and arm retainer 62 as shown in FIG. 3.

When the front and rear portions 14 and 16 are assembled together, member 68 is mounted in circular apertures formed by the semicircular apertures 24 and 32 with ball members 74 and 76 disposed outside the torso member 12. Plate 78 engages slot 44 and the similar slot existing at the inside surface of front portion 14 when the leg and arm retainer 62 is assembled inside the torso member 12. In addition, retainer 62 is assembled so that extensions 64 and 66 are mounted in the circular apertures formed by the semicircular apertures 40 in webs 36 and similar semicircular apertures in the webs attached to the inside suface of front portion 14. The extensions 64 and 66 are also mounted in the circular apertures formed by semicircular apertures 22 and 30 with ball members 70 and 72 positioned outside the torso member 12. When the retainer 62 is mounted, the desk-shaped members 65 and 67 are positioned adjacent webs 36 and the webs attached to the inside surface of the front portion 14 to prevent movement of ball members 70 and 72 toward the torso member 12.

Figure 4:
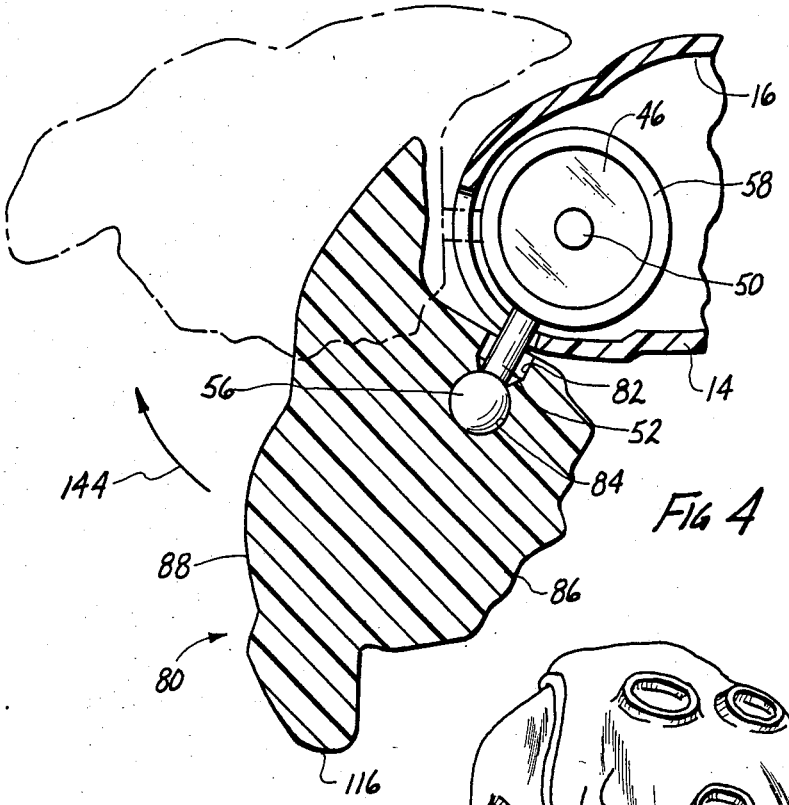
FIG. 4 is an enlarged cross sectional view taken along line 4—4 shown in FIG. 1.

A head member 80 is rotatably coupled to the head retainer 46 by forcing ball member 56 past cylindrical bore 82 and into spherical socket 84 in member 80 to form a ball joint as shown in FIG. 4. The tolerances of the ball joint allow the head member 80 to be uncoupled from the head retainer 46 without breaking any parts. This feature helps to prevent damage to the toy 10 when the head member 80 is accidentally pulled from the toy by a child during play. The head member 80 may be replaced by simply pushing ball member 56 into spherical socket 84. As shown in FIGS. 2 and 3, the head member 80 has a surface 86 simulating the face of a robotic humanoid figure and another surface 88 (see also FIGS. 1 and 4) simulating the surface of a rock. The words robotic humanoid as used herein refer to either robotic or humanoid features.

Two arm members 90 and 92 are rotatably coupled to the horizontal extensions 64 and 66 by forcing ball members 70 and 72 past cylindrical bores 94 and into spherical sockets (not shown) in each arm member located at surfaces 96 and 98 (see FIGS. 2 and 3) of the arm members (only one cylindrical bore 94 is shown in FIG. 3 but a similar bore exists at surface 96). The ball joints formed by the cylindrical bores 94, spherical sockets and ball members 70 and 72 are preferably similar to the ball joint shown in FIG. 4. Note that the arm members 90 and 92 may be pulled free of the ball members 70 and 72 and then recoupled to the toy 10 in the same manner as the head member 80 may be coupled and uncoupled from the head retainer 46. As best illustrated in FIGS. 2 and 3, the arm members 90 and 92 have surfaces 96 and 98, respectively, simulating the arms of a robotic humanoid figure and surfaces 100 and 102, respectively, simulating rock surfaces.

Leg members 104 and 106 shown in FIGS. 2 and 3 also have surfaces 108 and 110, respectively, simulating rock surfaces. Note that surfaces 112 and 114 of the leg members 104 and 106, respectively, simulate the legs of a robotic humanoid figure. Like arm members 90 and 92, both leg members 104 and 106 have cylindrical bores 105 and spherical sockets (not shown) which are used to rotatably couple the leg members to the horizontal member 68. Ball members 74 and 76 engage the cylindrical bores 105 and spherical sockets to form ball joints similar to the joint shown in FIG. 4.

Because the head member 80 is rotatably coupled to the head retainer 46 and the arm and leg members 90, 92, 104 and 106 are rotatably coupled to the Y-shaped leg and arm retainer 62, all of these members may be rotated relative to each other and to the torso member 12. As a result, the members may be rotated so that the toy 10 may be folded into the configuration shown in FIG. 1 with only surfaces 26, 88, 100, 102, 108 and 110 being visible. In this configuration, the toy 10 takes the appearance of a rock configuration since surfaces 18, 86, 96, 98, 112 and 114 are not visible.

When the toy 10 is configured as shown in FIG. 1, the toy is supported on ends 116, 118, 120, 122 and 124 of members 80, 90, 92, 104 and 106, respectively. As such, the toy 10 takes the appearance of a boulder or other rock configuration resting on a supporting surface.

In order to effectively conceal the robotic humanoid simulating surfaces of the toy 10 when it is folded to appear as a rock configuration as shown in FIG. 1, mating edges of each member are preferably formed or shaped to operably engage each other. For example, mating edges 126 and 128 of arm member 92 should operably engage mating edges 144 of head member 80 and 134 of leg member 106, respectively, along common lines 146 and 148 (see FIG. 1). Likewise, mating edges 130 and 132 of arm member 90 should operably engage mating edges 142 of head member 80 and 138 of leg member 104, respectively. Finally, mating edges 136 and 140 of leg members 106 and 104, respectively, should operably engage each other.

The toy 10 may be easily unfolded in the direction of the arrows 142 shown in FIG. 1 to reveal surfaces 18, 86, 96, 98, 112 and 114 and to reconfigure the toy so that it appears to be a robotic humanoid figure as shown in FIG. 2. When in this configuration, the toy 10 is supported on ends 122 and 124 of leg members 104 and 106. FIG. 4 illustrates how the head member 80 may be moved in the direction of arrow 144 to the position represented by dashed lines by simply rotating the head retainer 46.

Figure 5:
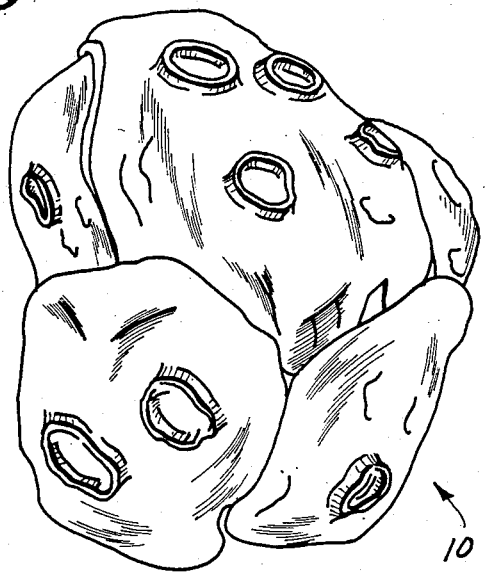
FIG. 5 is a perspective view of another preferred embodiment of the reconfigurable toy of the present invention shown folded into a rock configuration.
Figure 6:
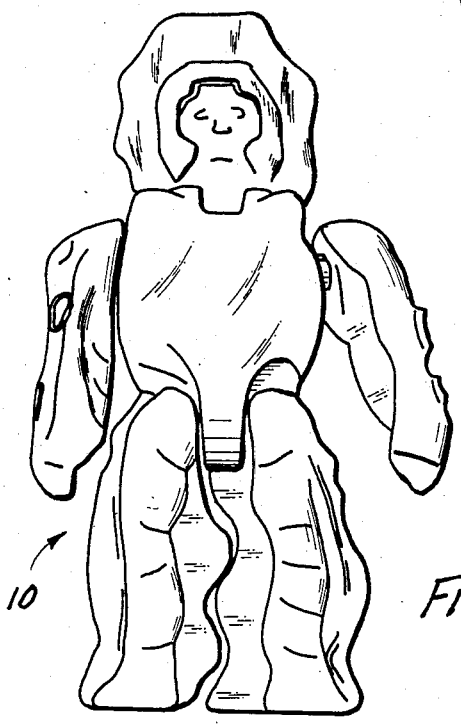
FIG. 6 is an elevational view of the toy of FIG. 5 reconfigured to simulate a robotic humanoid figure supported by leg members.

FIGS. 5 and 6 show a variation of the toy 10. Note that the rock simulating surfaces of the toy shown in a folded configuration in FIG. 5 simulate a rock configuration with craters. Also note that the robotic humanoid figure represented by the robotic humanoid simulating surfaces of the unfolded toy shown in FIG. 6 appears different than the robotic humanoid figure shown in FIG. 2. It is important to note that the surfaces of the toy may be varied to produce any desired appearance or configuration.

The above description discloses the preferred embodiments of the present invention. However, persons of ordinary skill in the toy field are capable of numerous modifications once taught these principles. Accordingly, it will be understood by those skilled in the art that changes in form and details may be made to the above-described embodiments without departing from the spirit and scope of the invention.

We claim:

1. A reconfigurable toy comprising:

a hollow torso member having a slot at one end thereof, a plurality of apertures at both sides thereof, an outside surface simulating a torso of a robotic humanoid figure and an outside surface simulating a rock surface, said hollow torso member having a plurality of webs with apertures and two extensions with slots attached to inside surfaces thereof;

a head retainer rotatably mounted inside said hollow torso member, said head retainer having side pins rotatably engaging at least two of said apertures of said webs and a pin extending through said slot of said hollow torso member, said pin having a ball member attached to the end thereof and disposed outside said hollow torso member;

a Y-shaped leg and arm retainer mounted inside said hollow torso member, said leg and arm retainer having (a) a horizontal member extending through one of said apertures at each side of said hollow torso member with ball members attached to the ends thereof and disposed outside said torso member, (b) a plate engaging said slots of said two extensions of said hollow torso member and (c) two horizontal extensions engaging at least two of said apertures of said webs, each of said two horizontal extensions passing through one of said apertures at one of said sides of said hollow torso member and having a disk-shaped member attached thereto and a ball member attached to the end thereof and disposed outside said hollow torso member;

a head member having a surface simulating a face of a robotic humanoid figure and a surface simulating a rock surface, said head member being rotatably coupled to said head retainer by said ball member of said head retainer which operably engages a cylindrical bore and spherical socket in said head member;

two arm members each having a surface simulating an arm of a robotic humanoid figure and a surface simulating a rock surface, each of said arm members being rotatably coupled to said Y-shaped leg and arm retainer by one of said ball members attached to said two horizontal extensions which operably engages a cylindrical bore and spherical socket in each of said arm members; and two leg members each having a surface simulating a leg of a robotic humanoid figure and a surface simulating a rock surface, each of said leg members being rotatably coupled to said Y-shaped leg and arm retainer by one of said ball members attached to said horizontal member which operably engages a cylindrical bore and spherical socket in each of said leg members.

2. The reconfigurable toy of claim 1 wherein each of said head, arm and leg members has mating edges, each of said mating edges of one of said members capable of operably engaging one of said mating edges of another of said members positioned adjacent to said one of said members.

3. A reconfigurable toy comprising:

a hollow torso member having a rock simulating surface and a surface simulating a torso of a robotic humanoid figure;

a head member rotatably coupled to said torso member, said head member having mating edges, a rock simulating surface and a surface simulating a face of a robotic humanoid figure;

two arm members rotatably coupled to said torso member, each of said two arm members having mating edges, a rock simulating surface and a surface simulating an arm of a robotic humanoid figure;

two leg members rotatably coupled to said torso member, each of said two leg members having mating edges, a rock simulating surface and a surface simulating a leg of a robotic humanoid figure;

first means for rotatably coupling said head member to said torso member so that said head member is capable of being selectively moved to at least first and second positions with respect to said two arm members and said two leg members, said first position of said head member disposing said head member so that said surface simulating a face of a robotic humanoid figure is visible and said mating edges of said head member are disposed away from said mating edges of said arm members, said second position of said head member disposing said head member so that each of said mating edges thereof operably engages an adjacent one of said mating edges of one of said arm members, said first means including a head retainer rotatably mounted inside said torso member; and second means for rotatably coupling said two arm members and said two leg members to said torso member so that said arm and leg members are capable of being selectively moved to at least first and second positions with respect to each other and said head member, said first position of said arm and leg members disposing said arm and leg members so that said surfaces simulating arms and legs of a robotic humanoid figure are visible and said mating edges of said arm members are disposed away from said mating edges of said leg members, said second position of said arm and leg members disposing said arm and leg members so that each of said mating edges of one of said arm members operably engages and adjacent one of said mating edges of said head member and an adjacent one of said mating edges of one of said leg members, and each of said mating edges of one of said leg members operably engages an adjacent one of said mating edges of one of said arm members and an adjacent one of said mating edges of the other of said leg members, said reconfigurable toy simulating a robotic humanoid figure when said head, arm and leg members are disposed in said first position and a rock configuration when said head, arm and leg members are disposed in said second position, said second means including a Y-shaped leg and arm retainer mounted inside said torso member.

* * * * *